United States Patent [19]

Badoux et al.

[11] Patent Number: 4,683,112

[45] Date of Patent: Jul. 28, 1987

[54] STEAM GENERATOR, PARTICULARLY FOR PRESSURIZED WATER NUCLEAR REACTOR

[75] Inventors: Jean-Paul Badoux, Le Puy Sainte; Jean E. Chaix, Pierrevert; Michel Metteey, Eguilles, all of France

[73] Assignee: Commissariat A L'Energie Atomique, Paris, France

[21] Appl. No.: 712,176

[22] Filed: Mar. 15, 1985

[30] Foreign Application Priority Data

Mar. 23, 1984 [FR] France ..... 84 04563

[51] Int. Cl.[4] ..... F22B 37/64

[52] U.S. Cl. ..... 376/402; 122/511

[58] Field of Search ..... 376/402; 122/511

[56] References Cited

U.S. PATENT DOCUMENTS 2,343,502 3/1944 Fields .
2,807,445 9/1957 Gardner ..... 122/511
4,162,191 7/1979 Cella ..... 376/402
4,242,987 1/1981 Viessmann ..... 122/511

FOREIGN PATENT DOCUMENTS 1119884 12/1951 Fed. Rep. of Germany .
7312164 4/1974 Fed. Rep. of Germany .
1228182 4/1960 France .

*Primary Examiner*—Deborah L. Kyle
*Assistant Examiner*—Richard L. Klein
*Attorney, Agent, or Firm*—Kerkam, Stowell, Kondracki & Clarke

[57] ABSTRACT

Steam generator, particularly for a pressurized water nuclear reactor, which has in per se known manner a water box in which circulates the hot water from the reactor core, and then enters a series of heat exchange tubes installed in a tube plate and extending within a secondary ferrule traversed by the secondary water, wherein the water box, secondary ferrule and tube plate are three independent, disassemblable assemblies.

1 Claim, 4 Drawing Figures

FIG. 2
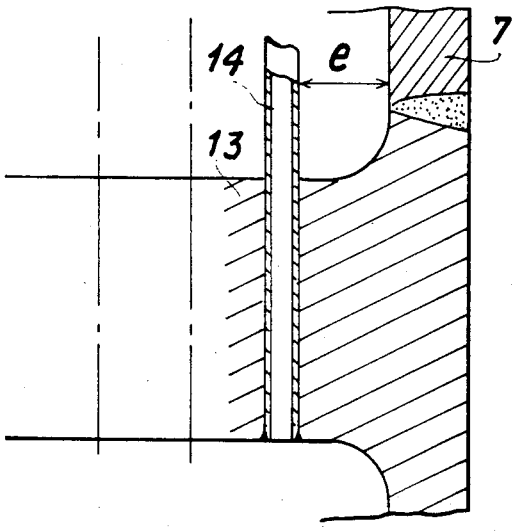
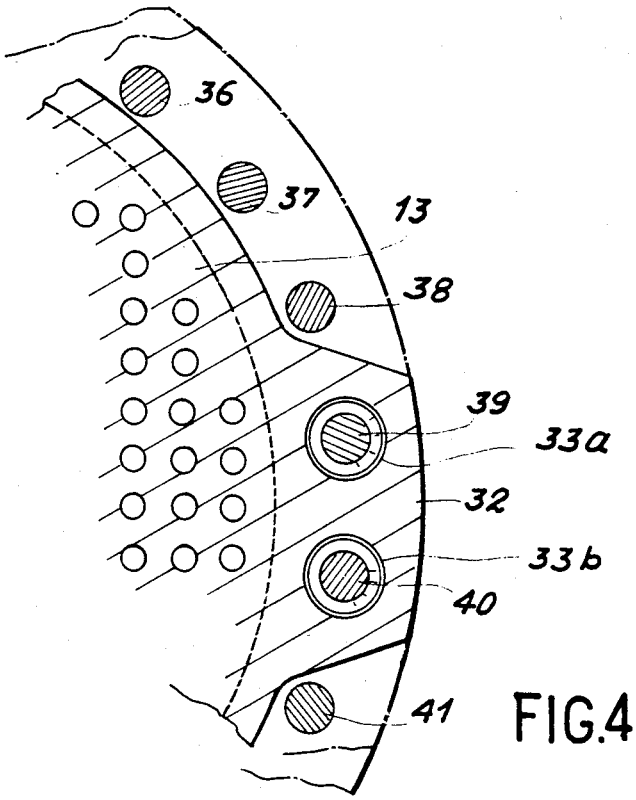
FIG. 4

STEAM GENERATOR, PARTICULARLY FOR PRESSURIZED WATER NUCLEAR REACTOR

BACKGROUND OF THE INVENTION

The invention relates to a steam generator, particularly for a pressurized water nuclear reactor.

In the nuclear industry, steam generators are known, which are used in conjunction with pressurized water reactors and whereof one per se known type is described with reference to FIG. 1. FIG. 1 shows the enclosure 1 of the reactor containing core 2 and in which circulates, on the one hand, at 3 the rising hot water leaving the core in the direction of arrow F and, on the other hand, the descending cold water circulating between envelope 1 and the reactor basket 4.

In per se known manner, steam generator 5 has a water box 6, in which circulates the water coming from reactor 1 whilst, above said water box 6, there is a ferrule 7 traversed by secondary water entering at 8 and leaving at 9 with respect to said secondary ferrule 7. A pipe 10 connects reactor 1 to the water box 6 and has two concentric annular passages, namely a central passage 11 by which the hot water enters water box 6 and a peripheral passage 12 by which the cold water from water box 6 leaves and returns to the reactor 1 between the basket and the enclosure to be reinjected at the bottom of the core.

In known manner, water box 6 is separated from the secondary ferrule 7 by a tube plate 13, in which are vertically installed a certain number of inverted U-shaped heat exchange tubes 14 and traversed by primary fluid. The water box 6 is subdivided into two parts, namely a hot compartment 15 and a cold compartment 16. The secondary water which travels in rising manner within the secondary ferrule 7, heats and evaporates progressively whilst rising along the U-tubes 14.

In all existing steam generators of loop reactors, such as described hereinbefore, or integrated reactors of the CAP type, for which the primary vessel acts as a water box, the secondary ferrule 7 is directly welded to tube plate 13, which is jammed on to the water box 6. As a result of the large pressure difference (approximately 100 bars) to which the tube plate 13 is exposed, stresses are accumulated in the angular connecting zone of said plate 13 to secondary ferrule 7. In order not to weaken this zone, it is consequently not possible to perforate the plate too near to its junction with the secondary ferrule 7 in order to install tubes there, which increases the overall dimensions of the steam generator in the manner shown in FIG. 2, where it is possible to see that a minimum space e is necessary between the side wall of the secondary ferrule and the first tube 14 installed in the tube plate 13.

Moreover, the secondary part of such a steam generator cannot be disassembled and it is therefore very difficult to repair it or even clean it when necessary after a certain period of operation and its inspection whilst in service is a complicated, dangerous operation.

SUMMARY OF THE INVENTION

The present invention relates to a steam generator for a pressurized water nuclear reactor which permits, by using simple means, the formation of a connection between the secondary ferrule and the tube plate without accumulating lateral stresses and which also makes the steam generator dismantlable in an integral manner.

The present invention therefore specifically relates to a steam generator, particularly for pressurized water nuclear reactors, comprising in per se known manner a water box, in which circulates the hot water leaving the reactor core in order to then penetrate a series of heat exchange tubes, installed in a tube plate and extending within a secondary ferrule traversed by secondary water, the water box, the secondary ferrule and the tube plate being three independent, dismantlable assemblies, wherein the secondary ferrule is terminated in its lower part by an annular neck having on the one hand a double conical bearing surface cooperating by two O-rings with a female groove having two conical bearing surfaces hollowed from the upper surface of the tube plate and on the other hand, on its outer periphery, a conical bearing surface associated with a locking ring; the upper part of the water box is terminated by a flange provided with a planar connecting bearing surface with two interposed O-rings, on the inner surface of the tube plate; and a system of tie bolts, certain of which pass through handling brackets on the periphery of the tube plates, whilst studs installed in the flange of the water box and nuts ensure, by means of the locking ring, the assembly and tight locking of the three aforementioned independent assemblies.

According to an important feature of the present invention, the handling brackets installed on the periphery of the tube plate have recesses, whereof the conical profile makes it possible to receive the conical collars equipping the studs so that, during a dismantling manipulation of the water box alone, it is possible to handle the tube plate-secondary ferrule assembly without breaking the seal thereof.

In the steam generator according to the invention, the secondary ferrule, the tube plate and the water box are consequently independent and completely disassemblable assemblies. Moreover, the sealing of the water box and the secondary enclosure of the steam generator take place in an overall manner and by independent means. Thus, in the generator according to the invention, it is possible to completely eliminate stresses from the angular connecting area of the tube plate to the secondary ferrule, which makes it possible to increase the number of heat exchange tubes contained in said ferrule, whilst the integral SO dismantlability of the steam generator makes it much easier to use than the prior art welded generators.

BRIEF DESCRIPTION OF THE DRAWINGS

The invention will be more readily understood from the following description of an embodiment given in an illustrative and non-limitative manner of such a steam generator and with reference to the attached FIGS. 3 and 4, wherein show:

FIG. 2—the detail of a junction between tube plate and ferrule according to prior art.

FIG. 4—a cross-sectional plan view along axis XX of FIG. 3, showing the peripheral arrangement of the tube plate and the position of the various tie bolts for maintaining the structure.

DETAILED DESCRIPTION OF THE PREFERRED EMBODIMENTS

Figure 1:
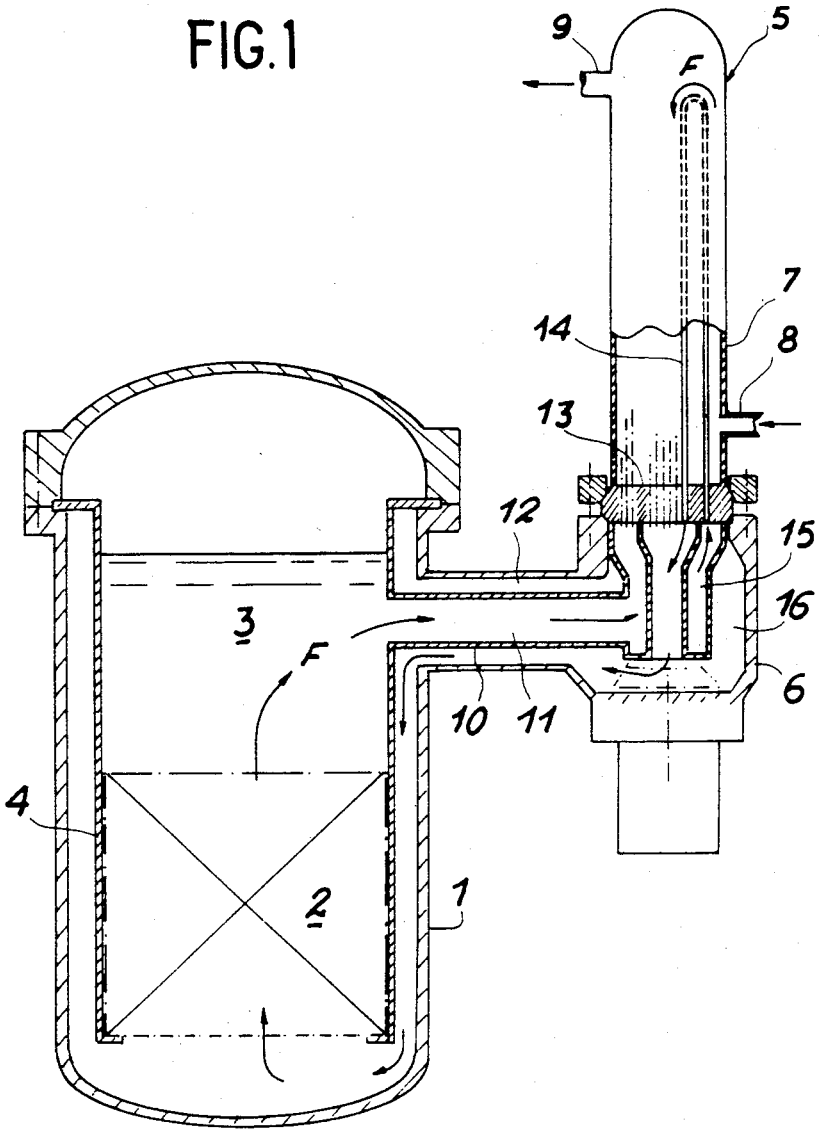
FIG. 1—a simplified sectional view in elevation of a pressurized water reactor including a conventional steam generator.
Figure 3:
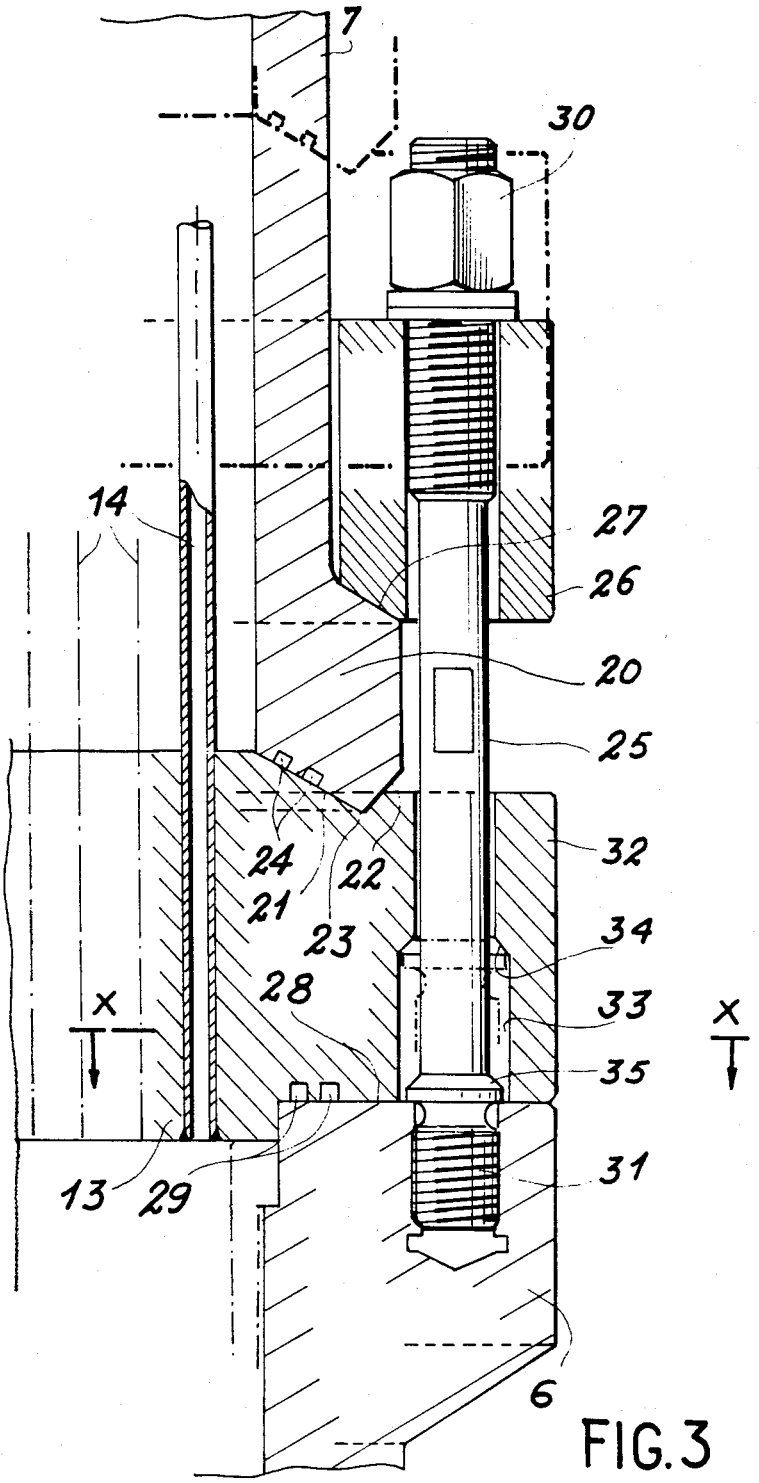
FIG. 3—a sectional view in elevation showing in detail the maintaining in tight contact of the tube plate of both the secondary ferrule and the water box.

FIG. 3 shows the secondary ferrule 7, the tube plate 13 and the water box 6. According to the invention, the lower part of the secondary ferrule 7 is terminated by an annular neck 20 having a double conical bearing surface 21, 22 in its lower connecting part to tube plate 13. Thus, the latter has a corresponding female groove 23, which also has two conical bearing surfaces for cooperating with the conical bearing surfaces 21, 22 of neck 20. Two metal O-rings 24 ensure the seal between tube plate 13 and secondary ferrule 7 when, in the manner shown hereinafter, the assembly is secured by tie bolt 25 and locking ring 26. For this purpose, the upper part of neck 20 also has a conical bearing surface 27 cooperating with a corresponding bearing surface of locking ring 26. In the lower part of the device, water box 6 is provided with a connecting planar bearing surface 28 having two metal O-rings 29 interposed between the water box 6 and the tube plate 13.

The vertical locking of the three aforementioned locking of the three aforementioned assemblies is brought about with the aid of tie bolts 25, nuts 30 and studs 31 which, according to the invention, are located in water box 6.

As can be seen in FIG. 4, on the periphery of tube plates 13 are provided a certain number of handling brackets, such as 32, which have recesses 33 with a conical bearing surface 34 for the studs 3l which, for this purpose, have a conical collar 35, which abuts against the corresponding conical part 34. Thus, when it is desired for any reason, e.g. for a maintainance manipulation, to dismantle the water box 6 without breaking the seal of tube plate 13 and secondary ferrule 7, it is possible to handle said plate 13 using tie bolts 25 traversing brackets 32, whilst maintaining a tight contact with secondary ferrule 7. The sequence of the manipulations is then as follows. The first stage is to loosen the nuts 30 in fours and in several passes with the aid of extending jacks, without loosening them beyond a minimum torque imposed by the maintaining of the secondary sealing effect. In the final pass, the studs 31 corresponding to the brackets 32 are completely loosened and then unscrewed, followed by raising in the corresponding recesses 33, so that the conical collar 35 of each of them comes into contact with the conical bearing surface 34 of the bottom of the recess of the handling brackets 32. The studs 31, corresponding to the brackets 32, are then retightened, so as to again secure tube plate 13 and secondary ferrule 7, without permitting the loosening of the O-rings 24. The other studs 31 are now completely loosened.

According to a preferred embodiment of the invention, there are three handling brackets 32 on the periphery and each of them has two recesses 33*a*, 33*b* for the studs 31. These recesses 33*a*, 33*b* make it possible to protect the threads of studs 31 during handling operations. The number of studs used for taking up the locking action is determined in such a way that it is possible to obviate any possibility of any of them jamming during the manipulation.

FIG. 4 shows the tie bolt 36, 37, 38, 39, 40 and 41 which, via the corresponding studs 31 and nuts 30, ensure the locking of the secondary ferrule and the water box 6 on to the tube plate 13 and whereof two tie bolts 39, 40 are also used for the locking handling of the tube plate-secondary ferrule assembly during the disassembly of the water box 6.

The aforementioned steam generator has a certain number of advantages, the most important of which are the easy access to the secondary tubes 14 and to the internal structures of the generator. However, it also has a certain number of further advantages, which are listed below:

- with regards to the arrangement of the bundle of tubes, the elimination of the connection area at the bottom of the ferrule, which makes it possible to gain space for the installation of the tubes;
- the second ferrule neck works in compression and consequently more favourably than a conventional flange;
- the system makes it possible to prestress the tube plate, by giving it a downward sag at the time of locking;
- the double conical bearing surface ensures surface contacts making it possible to retain low contact pressure levels, as well as sliding conditions of a very satisfactory nature (sliding is stopped as soon as the play is taken up by the external conical bearing surface);
- the double slope system makes it possible to lower the stress level and consequently reduce the thickness of the tube plate, under otherwise identical conditions;
- from the manufacturing standpoint, the fact of the complete separation of the plate-tube bundle assembly constructional problems from those of the secondary ferrule assembly.

What is claimed is:

1. A pressurized water nuclear reactor steam generator, said nuclear reactor having a reactor core, comprising a water box, in which circulates the hot water leaving the reactor core in order to then penetrate a series of heat exchange tubes, installed in a tube plate and extending within a secondary ferrule traversed by secondary water, the water box, the secondary ferrule and the tube plate being three independent dismantable assemblies, wherein the secondary ferrule is terminated in its lower part by an annular neck having on the one hand a double concical bearing surface cooperating by two O-rings with a female groove having two conical bearing surfaces hollowed from the upper surface of the tube plate and on the other hand, on its outer periphery, a concical bearing surface associated with a locking ring; the upper part of the water box is terminated by a flange provided with a planar connecting bearing surface with two interposed O-rings; on the inner surface of the tube plate; and a system of tie bolts, certain of which pass through handling brackets on the periphery of the tube plates, whilst studs installed in the flange of the water box and nuts ensure, by means of the locking ring, the assembly and tight locking of the three aforementioned independent assemblies, further, wherein the handling brackets installed on the periphery of the tube plate have recesses with concial bearing surfaces, where the conical bearing surfaces make it possible to receive conical collars equipping the studs to that, during a dismantling manipulation of the water box alone, it is possible to handle the tube plate-secondary ferrule assembly without breaking the seal thereof.

* * * * *